US006224070B1

(12) United States Patent
Carpenter et al.

(10) Patent No.: US 6,224,070 B1
(45) Date of Patent: May 1, 2001

(54) ADJUSTABLE BINDING STRAP FOR SECURING A SNOWBOARD BOOT WITHIN A BASEPLATE

(75) Inventors: Jake B. Carpenter, Stowe; Christopher M. Doyle, South Lincoln, both of VT (US)

(73) Assignee: The Burton Corporation, Burlington, VT (US)

( * ) Notice: Subject to any disclaimer, the term of this patent is extended or adjusted under 35 U.S.C. 154(b) by 0 days.

(21) Appl. No.: 09/611,068

(22) Filed: Jul. 6, 2000

Related U.S. Application Data

(63) Continuation of application No. 09/062,968, filed on Apr. 20, 1998, which is a continuation of application No. 08/886,917, filed on Jul. 2, 1997, now Pat. No. 6,056,300, which is a continuation of application No. 08/780,485, filed on Jan. 8, 1997.

(51) Int. Cl.[7] ..... A63C 9/14

(52) U.S. Cl. ..... 280/14.2; 280/619; 280/624; 36/50.5; 24/588

(58) Field of Search ..... 280/601, 600, 280/11.14, 611, 619, 14.2, 624; 24/342.1, 453, 464, 580, 588, 452, 442, 685 K; 36/50.5

(56) References Cited

U.S. PATENT DOCUMENTS

| | | | |
|---|---|---|---|
| 301,333 | 7/1884 | Brown . | |
| 1,439,806 | 12/1922 | Elias . | |
| 2,531,763 | 11/1950 | Andre | 36/50.5 |
| 4,624,064 | 11/1986 | Pozzebon . | |
| 5,088,212 | 2/1992 | Trinkaus et al. . | |
| 5,609,347 | 3/1997 | Dressel | 280/14.2 |
| 5,820,139 | 10/1998 | Grindl . | |
| 5,857,700 | 1/1999 | Ross . | |
| 6,076,848 | 6/2000 | Rigal et al. | 280/634 |

FOREIGN PATENT DOCUMENTS

| | | |
|---|---|---|
| 9313766U1 | 4/1992 | (DE) . |
| 0793983A1 | 10/1997 | (EP) . |
| 0797936A1 | 10/1997 | (EP) . |
| 824942A1 | 2/1998 | (EP) . |
| 0839557A1 | 5/1998 | (EP) . |
| WO95/33534 | 12/1995 | (WO) . |
| WO97/28859 | 8/1997 | (WO) . |
| WO97/38764 | 10/1997 | (WO) . |

OTHER PUBLICATIONS

European Search Report for EP98100144*.
Santa Cruz Snowboards brochure, 96 (3 pp.).
Santa Cruz Snowboards brochure 96/97 (3 pp.).

*Primary Examiner*—Brian L. Johnson
*Assistant Examiner*—Avraham H. Lerner
(74) *Attorney, Agent, or Firm*—Wolf, Greenfield & Sacks, P.C.

(57) ABSTRACT

A binding strap for use in a soft boot snowboard binding is provided, the binding strap including a flexible, unitary binding member having an ankle section connected to a toe section by a midsection. The binding strap may be configured and dimensioned to preferably provide a rider with easy entry and exit from the strap. In addition, the shape and flexible nature of the binding makes it comfortable to use, while also allowing it to perform well by securely engaging the rider's boot to the snowboard. The unitary construction allows the binding strap to move in an integrated manner, while the surface area of the binding strap reduces pressure points by distributing pressure exerted by the binding over a relatively large surface area of the boot, and hence foot, of the rider.

68 Claims, 8 Drawing Sheets

ADJUSTABLE BINDING STRAP FOR SECURING A SNOWBOARD BOOT WITHIN A BASEPLATE

This application is a continuation of application Ser. No. 09/062,968, filed Apr. 20, 1998 entitled, "Adjustable Binding Strap for Securing A Snowboard Boot Within A Baseplate," and now pending, which is a continuation of application Ser. No. 08/886,917, filed Jul. 2, 1997, now U.S. Pat. No. 6,056,300, entitled, "Adjustable Binding Strap for Securing A Snowboard Boot Within A Baseplate," which is a continuation of application of Ser. No. 08/780,485, filed Jan. 8, 1997, entitled, "Unitary Strap For Use in A Soft Boot Snowboard Binding," now pending.

DESCRIPTION

1. Technical Field

The present application relates to a binding strap for use in a soft boot snowboard binding.

2. Background of Related Art

In the sport of snowboarding, bindings are utilized to secure a rider's boot, and hence foot, to the snowboard. A plate binding having adjustable bails is used with a hard shell by snowboard riders whose style is adapted to "carving" or higher speed riding which requires fluid movement from edge-to-edge, thereby "carving" deep into the snow. A soft boot binding includes two, or three straps for securing a soft snowboard boot favored by snowboard riders who "freeride" or perform "freestyle" (trick-oriented) snowboarding. Regardless of the snowboarding styles, there are three basic requirements snowboard riders look for in their binding: performance, comfort and convenience. A binding system should securely attach the boot of the rider to the board, allow the rider to comfortably maneuver the board by weight shifts, twisting and turning of the lower and upper body, and be easy to secure and adjust especially when inserting and releasing the rider's boot.

Conventional soft boot bindings come in either a two or three strap arrangement comprising an ankle strap, a toe strap and, in the three strap arrangement, a shin strap. The ankle strap may include an oblong strap member which has a first end with a number of holes to adjustably attach the strap to the sidewall of the baseplate by a nut and bolt combination which is received through the appropriate hole adjacent the instep of the boot. The second end of the ankle strap typically includes a ratchet buckle, such as the Slap Ratchet™ buckle available from Burton Snowboards of Burlington Vt., which matingly engages a toothed or serrated strap mounted to the sidewall of the baseplate adjacent the outer side of the boot. The Slap Ratchet buckle and serrated strap allow for incremental adjustment once the ankle strap is secured around the boot. Likewise, the toe strap also typically includes an oblong strap member which has a first end with a number of holes to adjustably attach the strap to the sidewall of the baseplate by a nut and bolt combination which is received through the appropriate hole adjacent the "big" toe of the rider. The second end of the toe strap also typically includes a clip, such as a Leverage Toe Clip™ available from Burton Snowboards, which mates with a serrated strap mounted to the sidewall of the baseplate adjacent the "little" or "pinkie" toe of the foot for incremental adjustment of the toe strap. The shin strap, when utilized, is typically mounted at a first end to the high-back portion of the binding by a fastener, such as a nut and bolt combination, and includes a ratchet buckle which matingly engages a toothed or serrated strap mounted to the sidewall high-back, adjacent the outer shin. Such soft boot bindings are available from Burton Snowboards, of Burlington, Vt., and include for example, the X2, Custom Freestyle, Freestyle, Freestyle XS, System, Lo-Back and Contact models.

A second type of soft boot binding, available from Flow, is a rear entry, one piece binding strap. The binding utilizes a single, symmetrical strap which encloses substantially the entire top region of the foot between the toe and the ankle area and is typically utilized with a high-back binding system. The one piece strap is attached at the toe and ankle area by a pair of ratchet buckles, each buckle being matingly engaged to a serrated strap.

While prior art soft boot bindings have proven to be effective, there is continued development in the field to provide a varied assortment of bindings which provide the rider with performance, comfort and convenience. The binding described in the present application is directed to one such binding offering performance, comfort and convenience to the rider.

SUMMARY

In accordance with the present invention there is provided a binding strap for use in a soft boot snowboard binding, the binding strap includes a flexible, unitary binding member having an ankle section connected to a toe section by a midsection. The binding strap is configured and dimensioned to preferably provide a rider with easy entry and exit from the strap. In addition, the shape and flexible nature of the binding makes it comfortable to use, while also allowing it to perform well by securely engaging the rider's boot to the snowboard. The unitary construction allows the binding strap to move in an integrated manner, while the surface area of the binding strap reduces pressure points by distributing pressure exerted by the binding over a relatively large surface area of the boot, and hence foot, of the rider.

In one embodiment the unitary binding member may be asymmetrical in construction and may further include an inwardly sloping outer edge from the ankle section towards the toe section. The unitary binding member may also include an inner edge defining a variable medial opening for moving the ankle section and toe section relative to each other.

In another embodiment the midsection may have a reduced width relative to the ankle section and toe section, and the binding strap may have a contoured shape in an unstressed configuration.

It is therefore an object of the invention to provide a binding member for use in a soft boot snowboard binding which is comfortable to use while performing well for a variety of riders.

It is another object of the invention to provide a unitary binding member which provides a rider with ease of entry and exit of the rider's boot from engagement with the binding strap.

It is yet another object of the invention to provide a binding member which distributes pressure exerted by the binding member over the surface area of the boot to reduce the number of pressure points.

BRIEF DESCRIPTION OF THE DRAWING

Various embodiments are described herein with reference to the drawings, wherein.

DETAILED DESCRIPTION OF THE PREFERRED EMBODIMENTS

Figure 1:
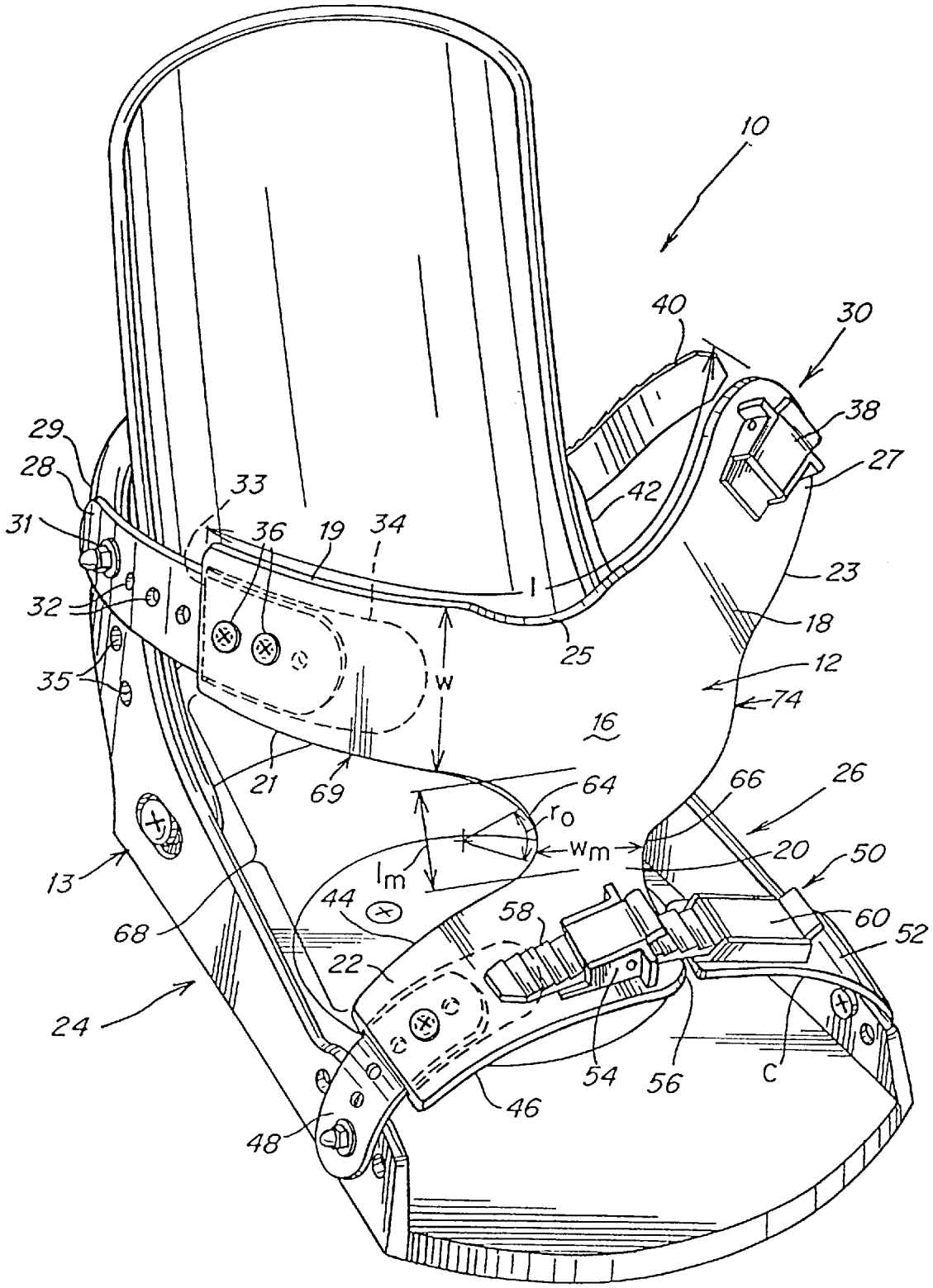
FIG. 1 is a perspective view of a soft boot snowboard binding including one embodiment of a unitary strap according to the present invention.
Figure 2:
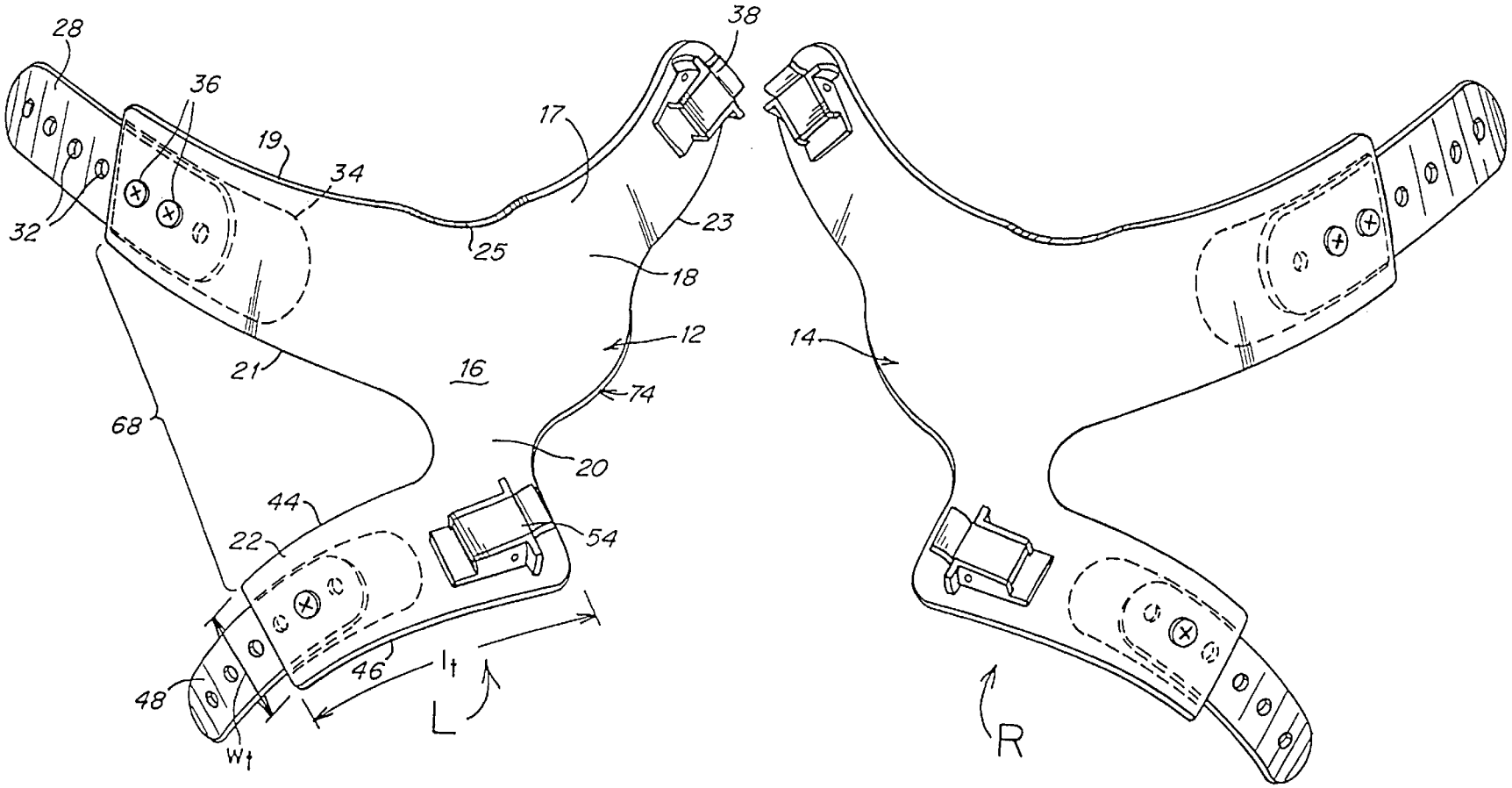
FIG. 2 is a perspective view of the unitary strap of FIG. 1.
Figure 4A:
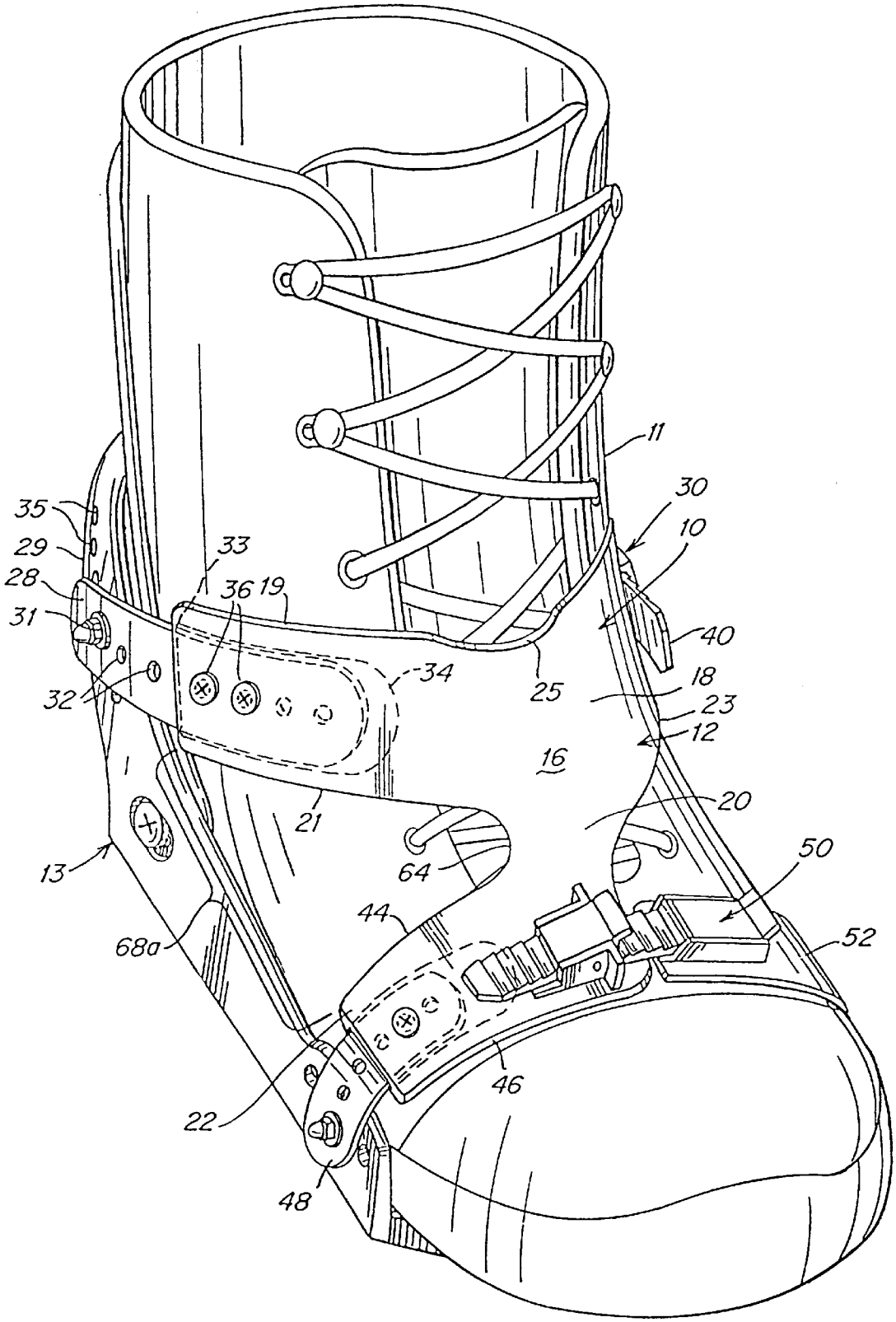
FIG. 4A is a perspective view of the unitary strap of FIG. 1, engaged in a first position with a soft snowboard boot.

Referring initially to FIGS. 1 and 4A, there is illustrated a perspective view of a binding 10 for use with a conventional soft snowboard boot 11. Binding 10 includes a binding strap 12 and a conventional baseplate 13, the baseplate preferably being secured to the snowboard by a removable hold down disc and locking screws, as is known in the art. Referring now to FIG. 2, there is illustrated a front view of a left, "L", binding strap 12 designed for use with the left foot of a snowboard rider, and a right, "R", binding strap 14 designed for use with the right foot of a snowboard rider, both right and left straps being designed and configured for use with the conventional baseplate 13. In the present embodiment, the right and left binding straps are mirror images of each other, and as such, the following description will be directed to the left strap 12, however, one of skill in the art will readily recognize the description applies equally to right strap 14, as well. In the present application, components of binding strap 12 which are disposed adjacent the inner, or instep portion of a user's foot will be referred to as being on the "inside" 24 of the binding, while components disposed adjacent the external, or outer portion of a user's foot will be referred to as being on the "outer side" 26 of the binding.

Figure 7:
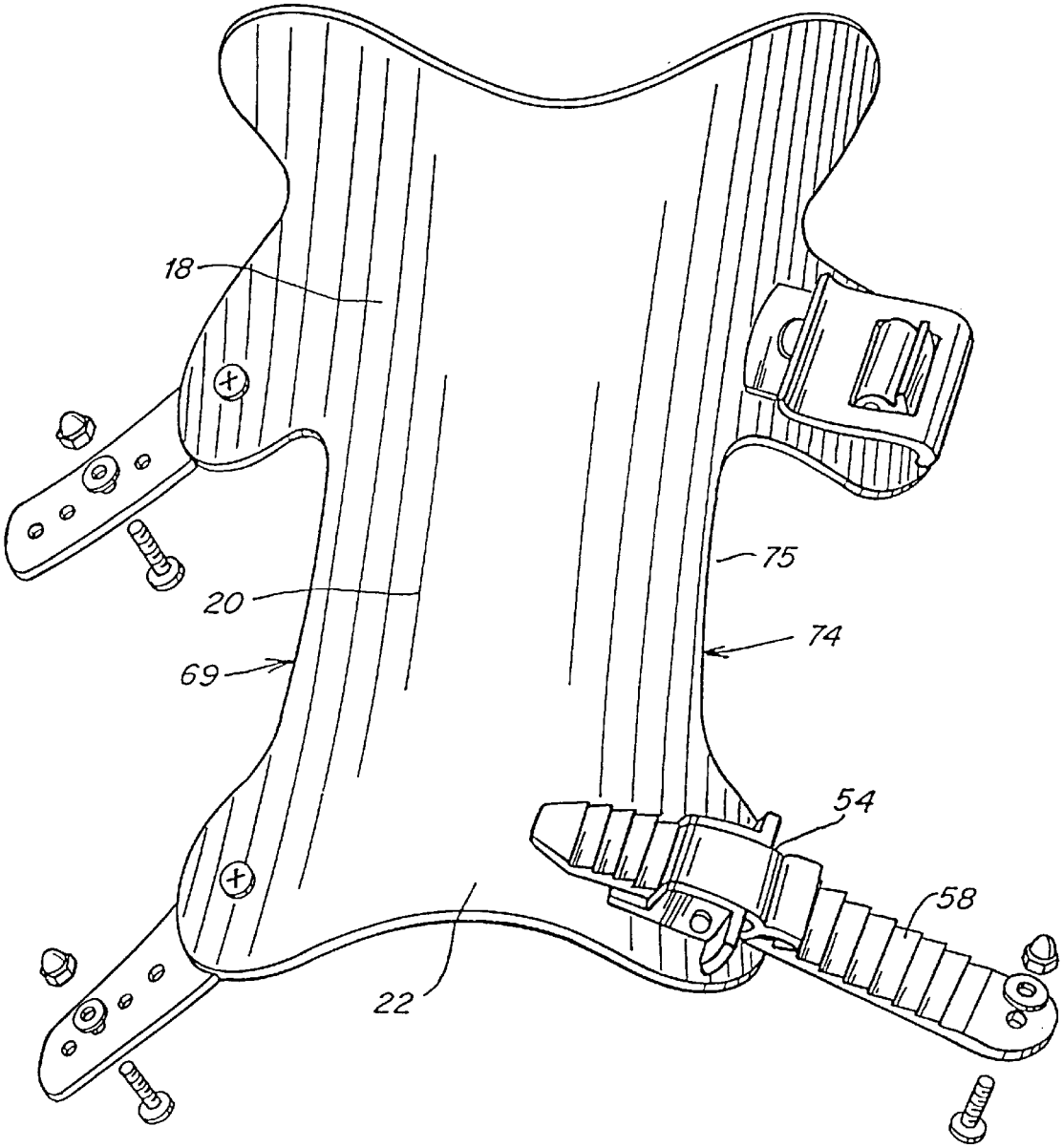
FIG. 7 is a front view of an alternate embodiment of a unitary strap according to the present invention.

With continued reference to FIG. 2, binding strap 12 preferably includes an unitary binding member 16 having an ankle section 18 connected to a toe section 22 by a midsection 20. The three sections cooperate to provide the rider with a comfortable, convenient binding strap that performs well in a variety of conditions, for a variety of users, as described in greater detail hereinbelow. The binding member 16 may be a one-piece construction, or alternately may consist of two or more pieces joined together, for example by stitching. As will be described in greater detail hereinbelow, the binding member 16 is preferably shaped to conform to the curvature of a rider's boot, and is designed with the anatomy of the foot in mind, in order to increase the comfort, convenience and performance of the strap. Binding strap 12 may be asymmetrical as shown in FIG. 1, or may alternatively be symmetrical, as shown in FIG. 7. In the present embodiment, binding member 16 is preferably formed of plastic material, which is injection molded into a curved die having contours similar to the human foot. A foam material is then switched over the injection molded material. Binding member 16 may also preferably include padding to provide cushioning and added comfort to the user. In the present embodiment, binding member 16 is approximately ⅛ to ¾ of an inch thick to provide padding as well as support to the rider during use. Alternately, binding member 16 may be formed of any material, or combination of materials (for example leather stitched over surlyn foam), which preferably provides support over the foot area while being flexible enough to bend as a rider moves, without splitting or cracking, in a cold weather environment. The material(s) may also preferably be waterproof and abrasion resistant, such as the outer surface 17, to withstand the rigors of a snowboarding environment where the binding member may be exposed to rough terrain, ice, rain, snow, branches and the like.

Figure 5:
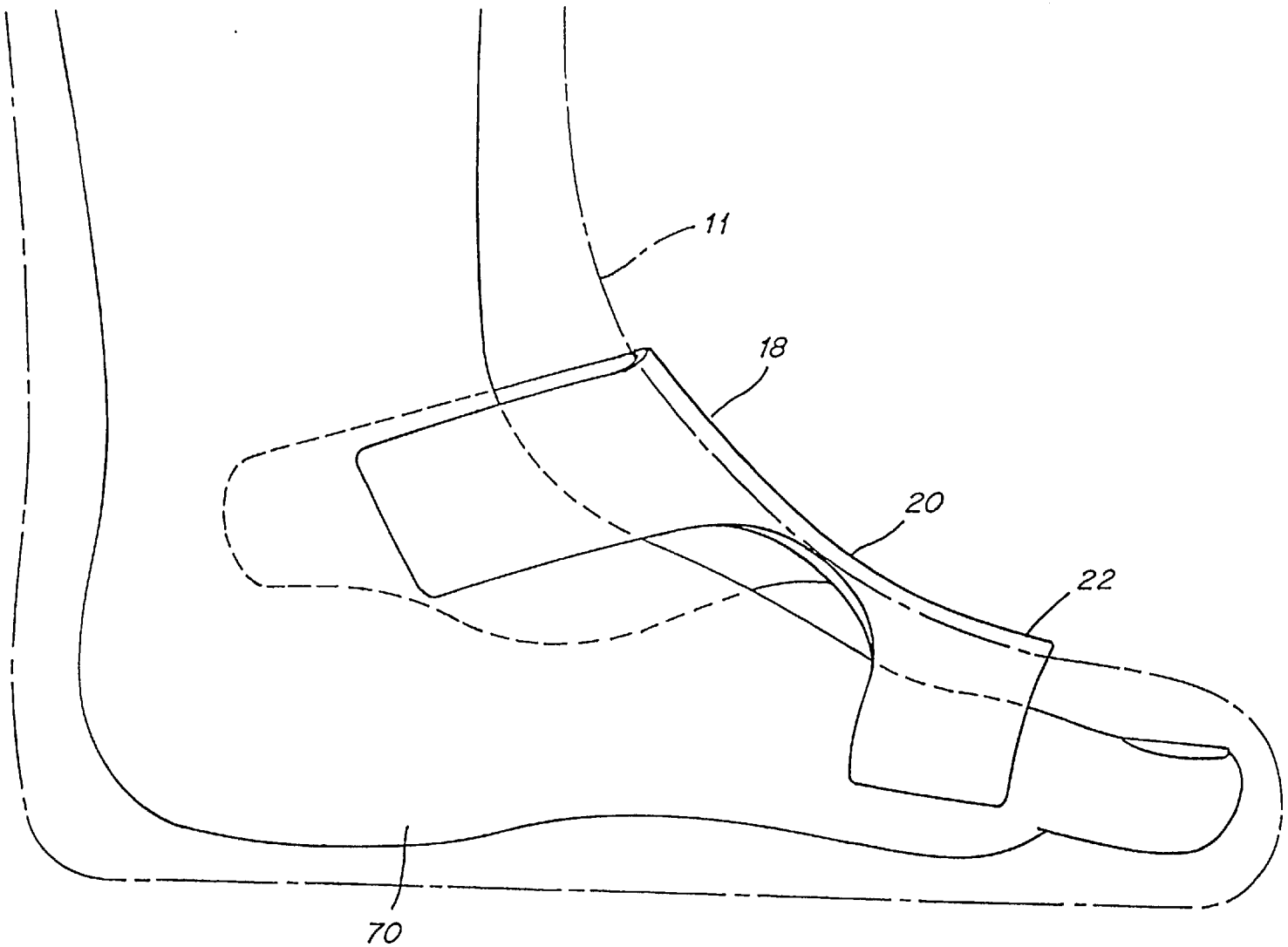
FIG. 5 is side view of the unitary strap of FIG. 1, shown in relationship to the outside of a rider's foot.
Figure 6:
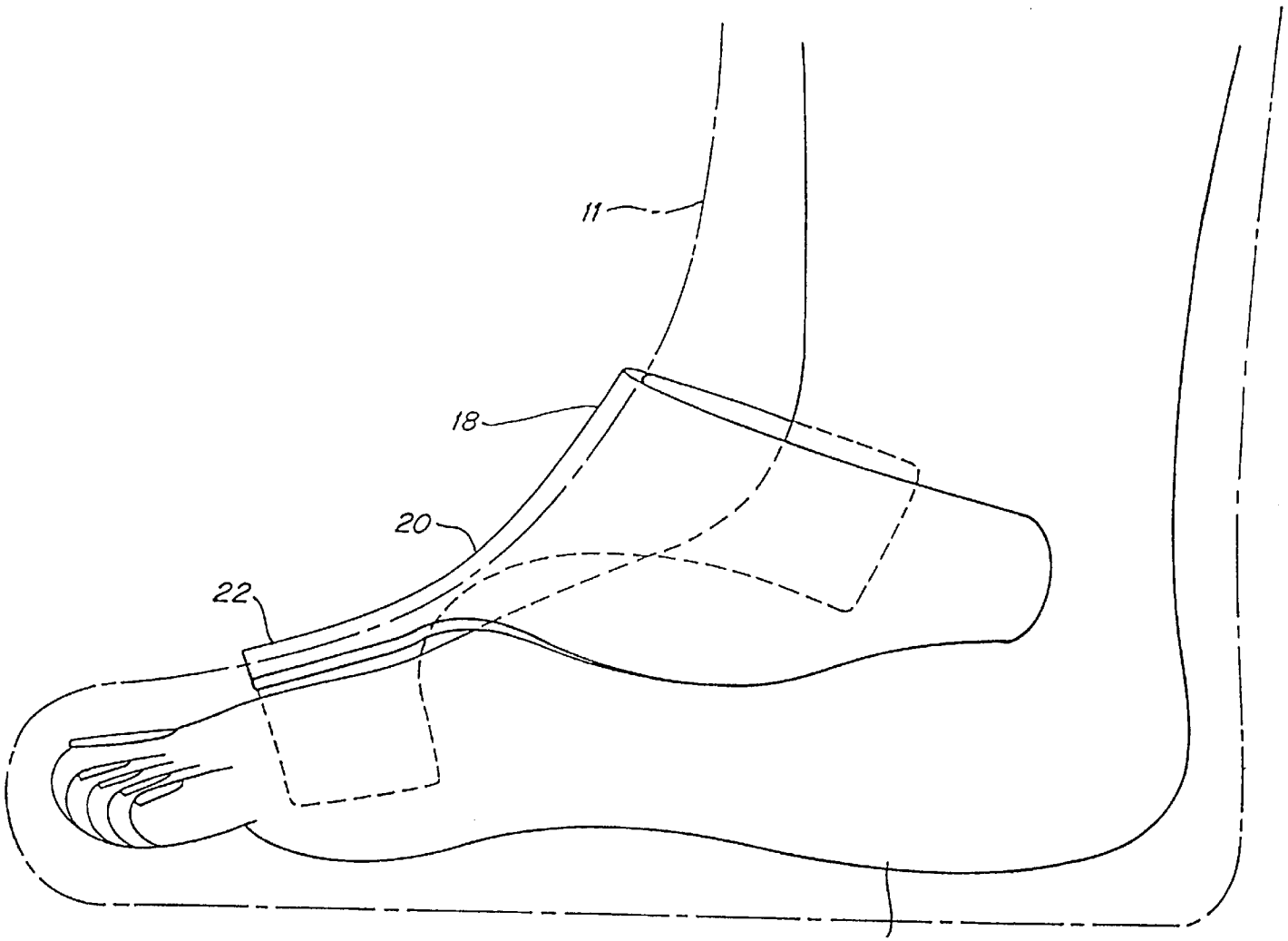
FIG. 6 is side view of the unitary strap of FIG. 1, shown in relationship to the inside of a rider's foot.

Referring now to FIG. 1 in conjunction with FIGS. 2 and 4A, ankle section 18 is designed to extend over substantially the entire ankle portion of a rider's boot, from approximately the inner ankle to the outer ankle, and is preferably attached on the inside of baseplate 13 by a mounting member. In the present embodiment, the area of ankle section 18 is preferably defined by a curved upper edge 19, a curved inside lower edge 21 and a sloping outer lower edge 23. The orientation of ankle section 18 may preferably be inclined with respect to toe section 22, in an unstressed configuration, in order to correspond to the inclined shape of boot 11 and the overall incline of a human foot, adjacent the ankle region (FIGS. 5 and 6). Alternatively, the ankle section 18 may be generally level with respect to toe section 22 in an unstressed configuration, but is flexible so as to conform to the incline of the boot when placed over boot 11. In the present embodiment, the incline of ankle section 18 may preferably be designed into the mold prior to injection of the binding material.

The overall contour of ankle section 18 may preferably be generally flat, while flexible, in an unstressed condition, so as to conform to the curved contour of the boot when placed over boot 11, as well as the overall contour of a human foot, adjacent the ankle region as shown in FIG. 4A. Alternately, the overall contour may be curved in an unstressed configuration, over substantially the entire ankle section 18, again to correspond to the curved contour of boot 11. If curved in an unstressed configuration, the contour may be designed into the mold prior to injection of the binding material. Upon incremental adjustment of the binding strap 12 about boot 11 of an individual rider, as described below, the curvature of the ankle section may change, whether the ankle section 18 is molded flat or curved, due to the flexible nature of the binding material. The flexible material, incline and curved contour allows the ankle section 18 to readily conform to, and securely and comfortably fit over, boot 11 and to naturally follow the curve of a rider's foot along the ankle portion.

In the embodiment of FIG. 1, the length, "l", of ankle section 18 as measured along the curved upper edge 19 is approximately 200 to 250 millimeters, while the width "w" of ankle section 18 is approximately 40 to 70 millimeters, as measured between the upper edge 19 and curved inside edge 21, once again to comfortably fit the majority of adult riders, although other dimensions are contemplated. A dimple 25 is also preferably molded into approximately the center of the inside portion of upper edge 19, in order to provide room for the large tendon, or tibialis anterior tendon, which is located at approximately the center of the foot, near the ankle region. Although it is an optional feature, the dimple 25 helps relieve pressure on the large tendon in order to provide added comfort to the rider, especially when leaning forward in the binding strap 12, which may tend to constrict the tendon.

In the present embodiment, ankle section 18 is secured to baseplate 13 by a mounting strap 28, attached to the inside of the baseplate, and is releasably secured over boot 11 by an engagement member 30. Although the following description is in reference to a mounting strap 28 and engagement member 30, it will be appreciated that other mounting techniques, for example buckles, may be readily utilized, as would be known to one of skill in the art.

As shown in FIGS. 1, 2 and 4A, mounting strap 28 includes a plurality of holes 32 disposed substantially along the length of the strap, to allow for adjustment of the ankle section over the boot 11 of the user. As is conventional, the baseplate 13 includes a number of holes 35 so that the ankle section 18 may be properly located over the ankle area for a variety of riders. A first end of the mounting strap 28 is preferably secured to the inside of baseplate 13 along the back portion 29 by fastener 31. In the present embodiment, fastener 31 comprises a nut and bolt, although other fastening devices will be known to one of skill in the art. A second end of the mounting strap 28 is preferably inserted through a slit 33 cut into the inside portion of ankle section 18 and into a pocket 34 formed internally within binding member 16. In use, after the first end of the mounting strap 28 is fastened to the back portion 29 of the baseplate, the rider inserts the second end through slit 33 and into pocket 34. The rider may then adjust the second end of the strap to suit his or her own preferences by moving a length of mounting strap 28 into the pocket to attain the desired fit. The rider can then secure the second end of mounting strap 28 inside the pocket 34 by using a fastener, such as screw 36, which engages one of the plurality of holes 32 to hold the mounting strap 28 in place. The adjustable mounting strap 28 allows a rider to make a first adjustment of the ankle section 18 of the binding strap depending upon the size of the riders boot and/or the desired tension on the ankle portion of the rider's foot. In the present embodiment, mounting strap 28 is made of plastic material, although any material which can securely attach the binding to the baseplate, while providing for adjustable positions, such as by holes, may be utilized. The use of pocket 34 in the present embodiment decreases the thickness associated with multiple layers of material, as the mounting strap 18 is received within binding member 16. The pocket 34 provides extra comfort because the thickness of the strap is not increased and a cushioning layer exists between the strap 28 and the boot of the rider.

Figure 3:
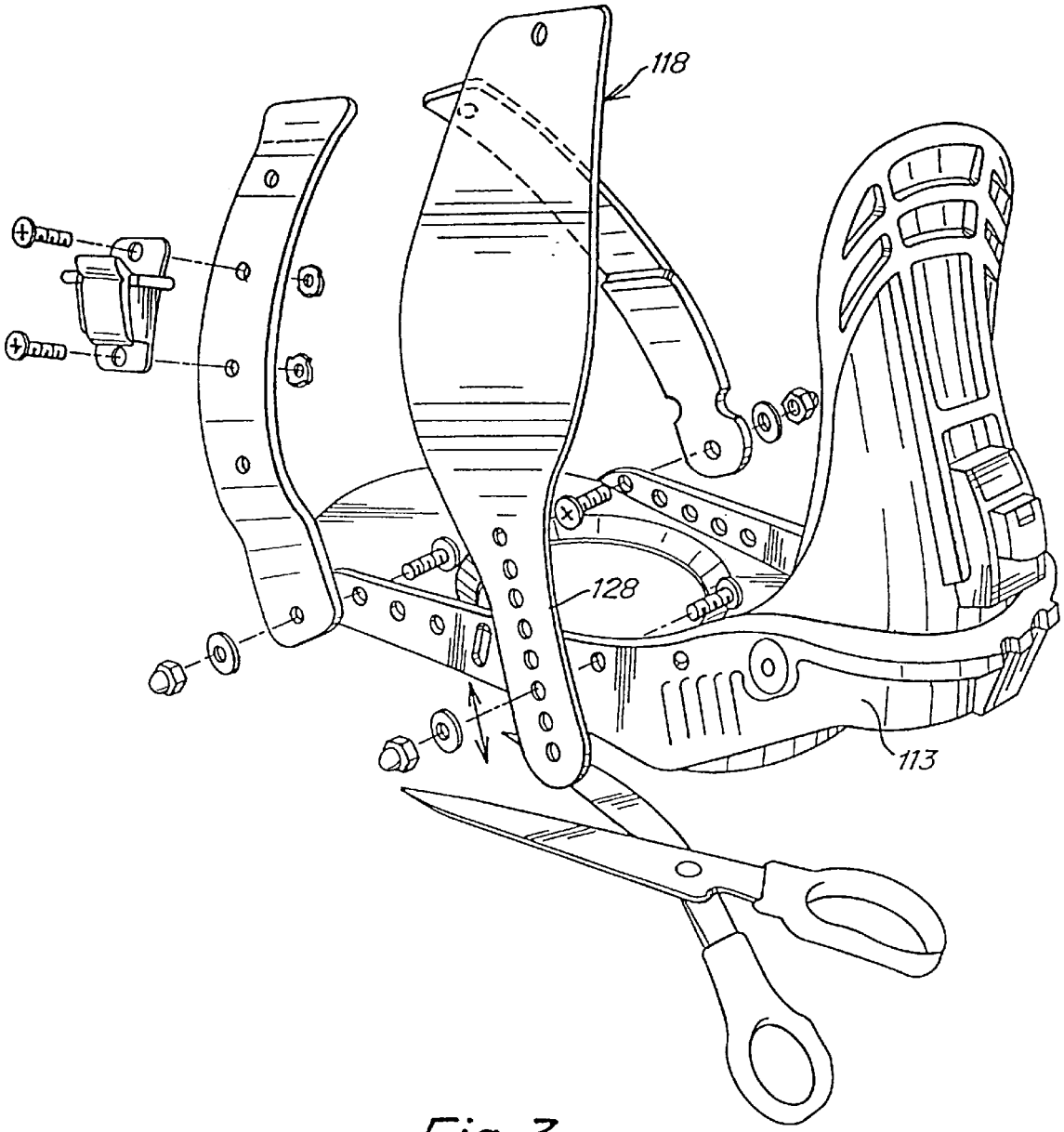
Fig. 3 (PRIOR ART)
FIG. 3 is a perspective view of a prior art soft boot snowboard binding.

In addition, unlike binding and mounting strap arrangements, pocket 34 allows for adjustment of ankle section 18 by movement of mounting strap 28 within pocket 34 without the need to cut excess strap, as any excess is held within pocket 34. In prior art mounting strap 128, as shown in FIG. 3, the mounting strap is integral with the ankle strap 118, and as such the second end of the mounting strap is part of the ankle strap 118 itself. Adjustment of the prior art mounting strap 128 is therefore achieved by moving only the first end of the strap 128 and securing a fastener through the appropriate hole. As shown in FIG. 3, this results in any excess strap 128 hanging down from the baseplate 113. Riders, therefore, generally cut the strap 128 to avoid the possibility of drag, thereby decreasing the adjustability of the strap by shortening it. In the present embodiment, the use of the adjustable mounting strap 28 within pocket 34 eliminates the need to cut the mounting strap 28, thereby retaining the full adjustability of the strap.

With continued reference to FIGS. 1 and 4A, ankle section 18 is releasably secured over boot 11 by engagement member 30, which can be a ratcheting buckle and strap. In the present embodiment, engagement member 30 includes a Slap Ratchet™ buckle 38 mounted to the outer side 27 of ankle section 18 and a serrated strap 40, mounted to the outer sidewall 42 of baseplate 13, by a fastener, for example a nut and bolt. Outer side 27 of ankle section 18 is preferably rounded so as to provide a comfortable fit by avoiding sharp edges which may tend to cut into the ankle or foot of the rider. Serrated strap 40 matingly engages slap ratchet 38 for incremental adjustment of binding strap 12 about the ankle section 18, as is known in the art. Engagement of strap 40 with Slap Ratchet 38 preferably occurs after mounting strap 28 is secured to the inside of baseplate 13, as described hereinabove.

Referring again to FIGS. 1 and 2, toe section 22 of binding member 16 may preferably be designed to extend over the metatarsal bones of the foot, adjacent the toes. In the present embodiment, toe section 22 may extend over the foot of a rider from approximately the 1st metatarsal, from which the hallux or big toe extends, to approximately the third metatarsal, from which the third toe extends. The toe section 22 may extend over the first to third metatarsal bones in order to provide maximum support without sacrificing comfort of the rider during snowboarding, as will be described in greater detail hereinbelow. Toe section 22 preferably includes an upper edge 44, a lower edge 46, and has a slightly curved contour along substantially the entire length of toe section 22, when placed over the boot of a rider. The curved contour of toe section 22 may preferably be generally flat, while flexible, in an unstressed condition, so as to conform to the curved contour of the boot when placed over boot 11, as well as the overall contour of a human foot, adjacent the toe region, as shown in FIG. 4A. Alternately, the overall contour of toe section 22 may be curved in an unstressed configuration, over substantially the entire toe section 22, again to correspond to the curved contour of boot 11. If curved in an unstressed configuration, the contour may be designed into the mold prior to injection of the binding material. Upon incremental adjustment of the binding strap 12 about boot 11 of an individual rider, as described below, the curvature of the toe section may change, whether the toe section 22 is molded flat or curved, due to the flexible nature of the binding material. The flexible material and curved contour allows the toe section 22 to readily conform to and comfortably fit over boot 11, and to naturally follow the curve of a rider's foot along the toe portion. In the embodiment of FIG. 1, the length, "$l_t$", of toe section 22 is approximately 70 to 110 millimeters, as measured along the lower edge 46, while the width, "$w_t$" of toe section 22 is approximately 40 to 70 millimeters, as measured along the inner edge of toe section 22, these dimensions being preferably chosen to again fit the majority of adult riders, although other dimensions are contemplated.

As described with reference to ankle section 18, toe section 22 is likewise secured to baseplate 13 by a mounting strap 48, attached to the inside of the baseplate, and is releasably secured over boot II by an engagement member 50 and toe strap 52, the toe strap being secured to the outer side of the baseplate. When secured to the baseplate 13, toe section 22 may be generally parallel to the bottom of baseplate 13. In the present embodiment, the structure and function of mounting strap 48 is similar to mounting strap 28, provided, however, that mounting strap 48 is preferably shorter in length than strap 28 and is secured to the inner sidewall of baseplate 13 adjacent the ball of a rider's foot. As shown in FIG. 1, a Leverage Toe™ clip 54 is preferably mounted to the outer side 56 of toe section 22 for adjustable engagement with a serrated strap 58 extending from ratchet buckle 60. Ratchet buckle 60 may preferably be utilized with clip 54 because the buckle allows the user to more tightly adjust or "crank down" binding 12 along the toe region, or front of a rider's foot, thus providing a more secure and comfortable fit than by using a traditional leverage clip alone. In the present embodiment, ratchet buckle 60 is mounted to one end of toe strap 52, the toe strap being fastened at a second end to the outer sidewall of baseplate 13, adjacent the ball of the rider's foot, by any suitable conventional fastener, for example a nut and bolt. Alternately, a leverage toe clip and serrated strap may be utilized as illustrated in FIG. 7, with toe section 22 preferably extending over the first through fifth metatarsal bones in this embodiment.

Toe strap 52 may preferably be formed of plastic material and may extend from the outer sidewall of baseplate 13 over the fourth and fifth metatarsal bones, in the present embodiment. Toe strap 52 preferably includes a slight curvature "c" to align with the contour of toe section 22 in order to create a slight arc, which helps secure the toe area, or front portion, of a rider's boot within binding 12 when strap 58 is secured within clip 54. Preferably, toe strap 52 does not overlap toe section 22 of binding member 16 in order to reduce material thickness in the toe region and to create the feel of a single toe member, thereby providing added comfort to the rider and ease of entry of the foot of the rider into the binding, as described in greater detail hereinbelow.

As shown in FIG. 1, midsection 20 preferably connects ankle section 18 with toe section 22 thereby forming unitary binding member 16. By connecting the ankle and toe sections, midsection 20 enables binding member 16 to act as a unified structure, thus enhancing comfort, performance and convenience of the binding strap 12. Midsection 20 preferably extends over the central top portion of a rider's foot and includes a curved inner edge 64 and a sloping outer edge 66. In the present embodiment, the width, "$w_m$" of midsection 20 between the inner and outer edges is from approximately 20 to 35 millimeters, while the length, "$l_m$", of midsection 20 between ankle section 18 and toe section 22 is from approximately 20 to 50 millimeters, to comfortably fit the majority of adult riders, although other dimensions are contemplated. As illustrated in FIGS. 1 and 7, the width "$w_m$" of midsection 20 is preferably less than the width "w" of ankle section 18 and is also preferably less than the width "$w_t$" of toe section 22 in order to enhance the flexibility of midsection 20. Inner edge 64 of midsection 20 preferably defines an apex of medial opening 68, the opening 68 being disposed on the inner edge 69 of binding strap 12. The medial opening 68 may preferably be delineated by the lower edge 21 of ankle section 18, the inner edge 64 of midsection 20 and the upper edge 44 of toe section 22, in the present embodiment.

Medial opening 68 provides added comfort and flexibility to binding strap 12 by allowing ankle section 18 and toe section 22 to move relative to each other, thereby increasing or decreasing the size, or radius of curvature "$r_o$", of the medial opening 68 over the instep portion of a rider's foot, as desired. In the present embodiment, the radius of curvature for the medial opening "$r_o$" is from approximately 6 to 12 degrees in an unstressed configuration, although other curvatures are contemplated. The ability to adjust the position of ankle section 18 and toe section 22 with respect to each other in a unitary binding strap 12 provides both the ankle and toe sections with the flexibility to be adjusted between the numerous mounting holes disposed in binding plate 13, by use of mounting straps 28 and 48, respectively, as described hereinabove. This adjustable positioning of ankle section 18 and toe section 22 allows a variety of riders to comfortably and effectively utilize binding strap 12, and also allows an individual rider to adjust the positioning of ankle section 18 with respect to toe section 22, as desired.

Figure 4B:
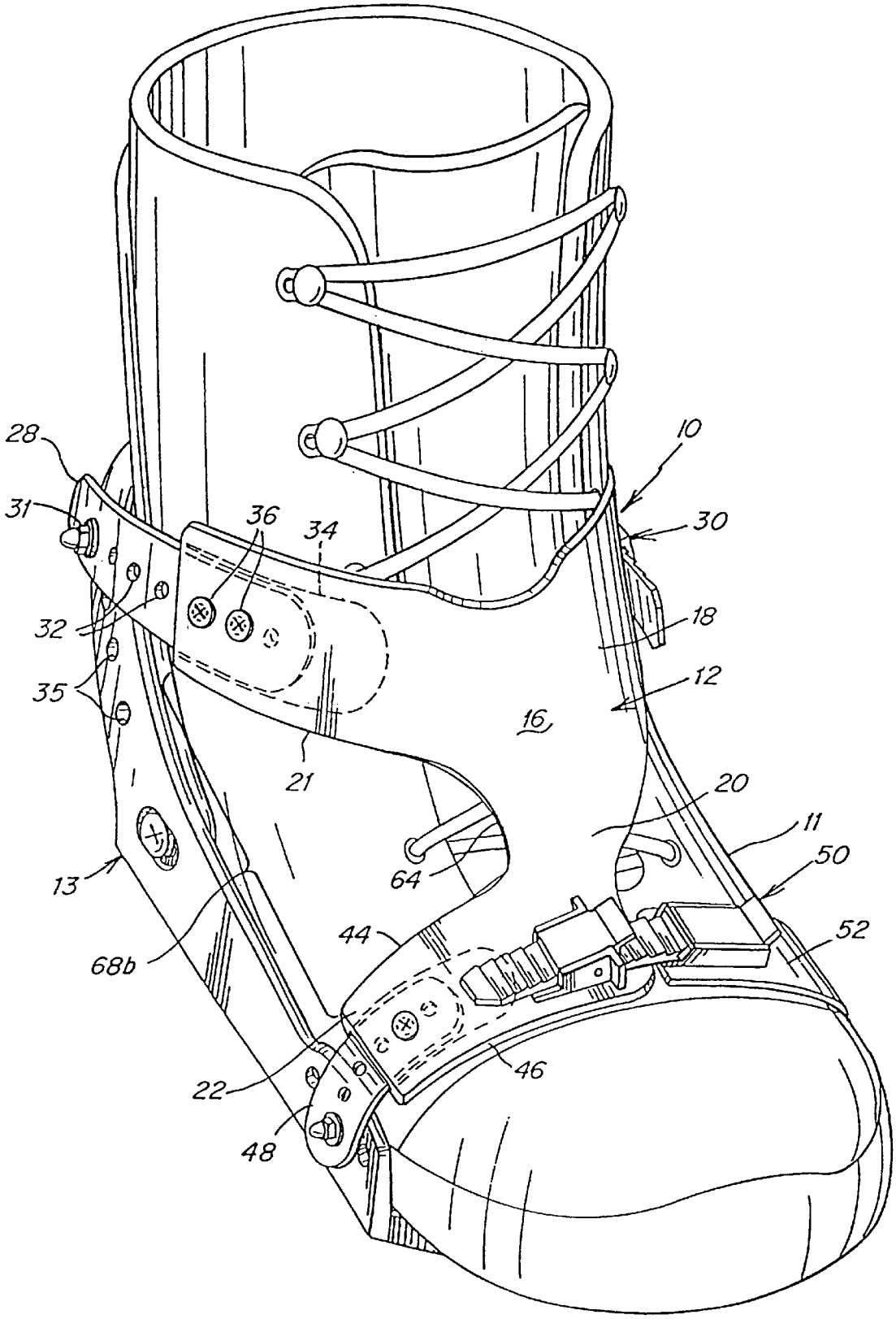
FIG. 4B is a perspective view of the unitary strap of FIG. 1, engaged in a second position with a soft snowboard boot.

For example, referring to FIG. 4A, the binding strap 12 is mounted with the ankle section 18 located across the ankle area of rider's foot 70. In the embodiment of FIG. 4A, the medial opening is designated as 68*a*. In FIG. 4B, the binding strap 12 is adjusted by moving ankle section 18 in a direction away from toe section 22, in order to mount ankle section 18 high on the back of baseplate 13 and above the ankle area of the rider's foot 70. The movement of ankle section 18 changes the size of the medial opening 68*a* by increasing the size of the opening, now designated as 68*b*. Although the relative positioning of the ankle and toe regions is adjusted, the binding strap 12 still firmly grasps and holds boot 11 without loss of comfort as the medial opening allows for such adjustment without noticeably increasing the pressure on a rider's foot 70.

Disposed opposite inner edge 69 of binding strap 12 is outer edge 74, which may preferably be contoured to the external side of a rider's boot and/or the anatomy of the foot, so as to enhance flexibility and further increase comfort of the binding strap when in use. Alternately, outer edge 74 may include an opening 75 as shown in FIG. 7. The sloping outer edge 74 is delineated in the present embodiment by the outer edges of ankle section 18, midsection 20 and toe section 22, and is approximately 190 millimeters in length. Although contoured in the present embodiment, outer edge 74 may, alternately be a substantially straight edge. In the present embodiment, outer edge 74 may preferably slope inwardly from the ankle section 18 to the toe section 22 and may include a slight inward curve adjacent the ankle to increase comfort and fit, and another curve adjacent the midsection 20 to increase flexibility of the midsection of the binding strap 12. As described further hereinbelow, the contoured shape of outer edge 74 may help to enhance ease of entry and exit of boot 11 from binding strap 12.

Referring again to FIG. 2, unitary binding strap 12 will be further described. Unitary binding strap 12 preferably includes ankle section 18 having an upper edge 19, toe section 22 having a lower edge 46, opposite the upper edge 44 and a flexible, midsection 20 connecting the upper and lower edges. Ankle section 18 is preferably inclined with respect to toe section 20, the toe section 20 being offset from ankle section 18. The flexible midsection allows the upper and lower edges to act as a flexible, unitary structure which moves as one and distributes pressure over substantially the entire area of the strap 12. In the present embodiment, binding strap 12 is preferably asymmetrical in construction, having a sloping outer edge 74 and a medial opening 68, or slit, along the inner edge of binding strap 12. Outer edge 74 may preferably slope inwardly from the ankle section 18 to the toe section 22 and may include a slight inward curve adjacent the ankle section to increase comfort, and another curve adjacent the midsection 20 to increase flexibility of the midsection of the binding strap 12. The medial opening 68 allows the ankle section 18 and toe section 22 to move toward and away from each other, thereby changing the size of the medial opening, and may be either an opening or simply a slit.

The slope, size and shape of the various sections may be modified, individually or collectively, to alter the performance, comfort and/or convenience of the binding strap as would be apparent to one of skill in the art.

Referring now to FIGS. 1–6, the operation of binding 10 will now be described. A rider preferably decides on the positioning of ankle section 18 in relation to the rider's foot, and then attaches mounting strap 28 to the inner sidewall of baseplate 13 by use of a fastener through the selected fastening hole, as described hereinabove. The rider likewise chooses the positioning of toe section 22 in relation to the rider's foot, and then proceeds to attach mounting strap 48 to the inner sidewall of baseplate 13, adjacent the big toe, as described hereinabove. Additional adjustment of the lateral positioning of ankle section 18 and toe section 22 may be achieved by moving mounting straps 28 and 48, respectively, within pocket members 34, as described hereinabove. The binding strap 12 is now mounted to baseplate 13, as shown in FIG. 5. The contoured shape of binding strap 12 naturally holds binding strap 12 in the position illustrated in FIG. 5, above baseplate 13, in a relaxed, or unstressed condition. The rider can, therefore, lift binding strap 12, insert soft boot 11, and upon releasing binding strap 12, the natural configuration of binding strap 12 will position the strap over the boot 11, thereby providing a rider with easy insertion of boot 11 under strap 12. In the present embodiment, the rider may actually lift the binding by kicking it with boot 11, the flexible binding acting like a wedge and naturally lifting and dropping into place over the boot. Thus, a rider may simply slide their boot under binding strap 12 from either the side or back of the binding. The natural configuration of binding strap 12 may be enhanced, at least in part, by flexible midsection 20, sloping outer edge 74 and toe section 22 which is preferably not overlapped by toe strap 52, in order to further enable the binding strap 12 to readily position itself over boot 11 during entry and to allow easy exit from binding strap 12.

After binding strap 12 is positioned over boot 11, the ankle and toe sections are further secured and incrementally adjusted about boot 11 by utilizing slap ratchet buckle 38 and ratcheting buckle 60, respectively, as described above. A rider can, therefore, readily tighten or loosen the pressure exerted by either ankle section 18 or toe section 22, or both. A rider may additionally secure a conventional shin strap (not shown), above binding strap 12, and around the shin of the rider. Once all straps are properly secured and adjusted, a rider is ready to begin snowboarding. To remove boot 11 from engagement with binding strap 12, slap ratchet buckle 38 and ratcheting buckle 60 are first released, and the rider may then readily "kick out" boot 11 from engagement with binding strap 12, or may alternately lift binding strap 12 with his or her hand.

Unitary binding strap 12 is therefore, convenient to use by providing a rider with easy entry, exit, and adjustment of the strap 12, as described hereinabove. Binding strap 12 is, additionally, comfortable to use, in part because it distributes pressure exerted by the binding over a relatively large surface area of the rider's foot, especially in comparison to conventional two-strap bindings. This, in turn, results in lesser pounds per square inch, or psi, over the area of the strap, thereby resulting in fewer pressure points on the foot, which allows the binding to be more tightly adjusted over the boot 11 in a comfortable manner, thereby providing the binding with additional performance features. In addition, the unitary construction and shape of binding strap 12 provides added comfort to the user by allowing the binding to respond to movement of the rider in an integrated fashion, while encompassing the foot to securely hold it in place. The shape of the binding strap 12 is also preferably designed so as not to bind blood vessels, or tendons and muscles, especially those running along the upper portion of the foot, such as the extensor hallucis longus tendon and muscle. The fit of binding strap 12 is enhanced by the flexible material and the overall configuration of the binding, including medial opening 68 and sloping outer edge 74. Finally, binding strap 12 provides a rider with the performance he or she desires by securely and snugly engaging the top portion of the rider's boot 11, and hence foot, in a comfortable manner which in turn allows a rider to "crank down" or tightly secure binding strap 12 about boot 11.

It will be understood that various modifications may be made to the embodiment disclosed herein. For example, the dimensions of the unitary binding member may be readily altered by one of skill in the art. In addition, the medial opening may be larger or smaller than shown. Therefore, the above description should not be construed as limiting, but merely as exemplifications of a preferred embodiment. Those skilled in the art will envision other modifications within the scope and spirit of the invention.

What is claimed is:

1. A binding strap for securing a snowboarding boot within a binding baseplate, the binding strap being mountable to the baseplate and releasably connectable to an engagement strap extending from the baseplate, the binding strap comprising:

a flexible binding strap member configured and arranged to be releasably connected to the engagement strap and to engage the snowboarding boot; and a mounting strap having a first section releasably securable to said flexible binding strap member via at least one fastener and a second section configured and arranged to engage the binding baseplate;

wherein said flexible binding strap member and said mounting strap are moveable relative to each other so that the length of said binding strap is selectively adjustable by a user;

wherein at least one of said flexible binding strap member and said mounting strap has a plurality of adjustment holes, each adjustment hole being adapted to receive one of the at least one fastener to adjustably secure the first section of said mounting strap to said flexible binding strap member; and wherein a portion of said mounting strap is insertable through a portion of said flexible binding strap member.

2. The binding strap according to claim 1, wherein said flexible binding strap member includes a buckle mounted to an outer portion of said flexible binding strap member, said buckle configured and arranged to engage a first section of the engagement strap.

3. The binding strap according to claim 2, wherein said buckle is a ratcheting buckle which matingly engages the engagement strap for incremental adjustment of the binding strap.

4. The binding strap according to claim 3, wherein the first section of the engagement strap includes a plurality of serrations and wherein said buckle is adjustably engagable with the plurality of serrations.

5. The binding strap according to claim 1, wherein said flexible binding strap member is a unitary binding strap member.

6. The binding strap according to claim 1, wherein said flexible binding strap member is pre-shaped so as to conform to a contour of the snowboarding boot.

7. The binding strap according to claim 1, wherein said mounting strap is a variable position mounting strap.

8. A binding for securing a snowboarding boot to a snowboard comprising:

a binding baseplate securable to the snowboard;

a binding strap including a binding strap member configured and arranged to engage the snowboarding boot and a mounting strap having a first section releasably securable to said binding strap member via at least one fastener and a second section engaged with said baseplate, said binding strap member and said mounting strap being moveable relative to each other so that the length of said binding strap is selectively adjustable by a user, wherein at least one of said binding strap member and said mounting strap has a plurality of adjustment holes, each adjustment hole being adapted to receive one of the at least one fastener to adjustably secure the first section of said mounting strap to said binding strap member, a portion of said mounting strap being insertable through a portion of said binding strap member; and an engagement strap extending from said baseplate and releasably connectable with said binding strap.

9. The binding according to claim 8, wherein said binding strap includes a buckle mounted to said binding strap member, said buckle being engagable with a first section of said engagement strap to releasably connect said binding strap with said engagement strap.

10. The binding according to claim 9, wherein said buckle is a ratcheting buckle that allows incremental adjustment between said binding strap and said engagement strap.

11. The binding according to claim 10, wherein said first section of said engagement strap includes a plurality of serrations that are engagable by said buckle.

12. The binding according to claim 8, wherein a first section of said engagement strap is releasably connectable with said binding strap and a second section of said engagement strap is engaged with said baseplate.

13. The binding according to claim 8, wherein said engagement strap is separable from said binding strap.

14. The binding according to claim 8, wherein said binding strap member is a unitary binding strap member.

15. The binding according to claim 8, wherein said binding strap member is pre-shaped so as to conform to a contour of the snowboarding boot.

16. The binding according to claim 8, wherein said mounting strap is a variable position mounting strap.

17. The binding strap according to claim 1, wherein said portion of said mounting strap insertable through said portion of said flexible binding strap member includes an end of said mounting strap, and wherein when said portion of said mounting strap is inserted through said portion of said flexible binding strap member, said end of said mounting strap is maintained in close proximity to said flexible binding strap member.

18. The binding strap according to claim 1, wherein said portion of said mounting strap insertable through said portion of said flexible binding strap member includes an end of said mounting strap, and wherein when said portion of said mounting strap is inserted through said portion of said flexible binding strap member, said end of said mounting strap conforms to a contour of said flexible binding strap member.

19. The binding strap according to claim 1, wherein said portion of said mounting strap insertable through said portion of said flexible binding strap member includes an end of said mounting strap, and wherein said binding strap further comprises means for, when said portion of said mounting strap is inserted through said portion of said flexible binding strap member, maintaining said end of said mounting strap in close proximity to said flexible binding strap member.

20. The binding strap according to claim 1, wherein said portion of said mounting strap insertable through said portion of said flexible binding strap member includes an end of said mounting strap, and wherein said binding strap further comprises means for, when said portion of said mounting strap is inserted through said portion of said flexible binding strap member, conforming said end of said mounting strap to a contour of said flexible binding strap member.

21. The binding strap according to claim 1, wherein said portion of said flexible binding strap member includes an opening, and wherein said portion of said mounting strap is insertable through said opening.

22. The binding strap according to claim 21, wherein said portion of said flexible binding strap member includes top and bottom walls that define a top and a bottom of said opening.

23. The binding strap according to claim 22, wherein said portion of said flexible binding strap member includes sides extending between said top and bottom walls.

24. The binding strap according to claim 23, wherein said portion of said flexible binding strap member includes an end extending between said top and bottom walls so that said opening is open only on one end.

25. The binding strap according to claim 21, wherein said portion of said flexible binding strap member includes sides.

26. The binding strap according to claim 21, wherein said opening comprises a slit.

27. The binding according to claim 8, wherein said portion of said mounting strap insertable through said portion of said binding strap member includes an end of said mounting strap, and wherein when said portion of said mounting strap is inserted through said portion of said binding strap member, said end of said mounting strap is maintained in close proximity to said binding strap member.

28. The binding according to claim 8, wherein said portion of said mounting strap insertable through said portion of said binding strap member includes an end of said mounting strap, and wherein when said portion of said mounting strap is inserted through said portion of said binding strap member, said end of said mounting strap conforms to a contour of said binding strap member.

29. The binding according to claim 8, wherein said portion of said mounting strap insertable through said portion of said binding strap member includes an end of said mounting strap, and wherein said binding strap further comprises means for, when said portion of said mounting strap is inserted through said portion of said flexible binding strap member, maintaining said end of said mounting strap in close proximity to said binding strap member.

30. The binding according to claim 8, wherein said portion of said mounting strap insertable through said portion of said binding strap member includes an end of said mounting strap, and wherein said binding strap further comprises means for, when said portion of said mounting strap is inserted through said portion of said flexible binding strap member, conforming said end of said mounting strap to a contour of said binding strap member.

31. The binding according to claim 8, wherein said portion of said binding strap member includes an opening, said portion of said mounting strap being insertable through said opening.

32. The binding according to claim 31, wherein said portion of said binding strap member includes top and bottom walls that define a top and a bottom of said opening.

33. The binding according to claim 32, wherein said portion of said binding strap member includes sides extending between said top and bottom walls.

34. The binding according to claim 33, wherein said portion of said binding strap member includes an end extending between said top and bottom walls so that said opening is open only on one end.

35. The binding according to claim 31, wherein said portion of said binding strap member includes sides.

36. The binding according to claim 31, wherein said opening comprises a slit.

37. A strap assembly for engaging a snowboarding boot, the strap assembly comprising:

an engagement strap having a first mounting section and a first engaging section, the first mounting section defining a first mounting portion for said strap assembly;

a boot-engaging strap member having a first section configured and arranged to be releasably connectable to said first engaging section of said engagement strap and a second section, said boot-engaging strap member being configured and arranged to engage the snowboarding boot; and a mounting strap having a second engaging section releasably securable to said second section of said boot-engaging strap member via at least one fastener and a second mounting section that defines a second mounting portion for said strap assembly;

wherein at least one of said boot-engaging strap member and said mounting strap has a plurality of holes, each hole being adapted to receive one of the at least one fastener to releasably secure said second engaging section of said mounting strap and said second section of said boot-engaging strap member; and wherein said boot-engaging strap member and said mounting strap are moveable relative to each other so that a length of said strap assembly between said first and second mounting portions of said strap assembly is selectively adjustable by a user.

38. The strap assembly according to claim 37, wherein said engagement strap is movable relative to said boot-engaging strap member so that the length of said strap assembly between said first and second mounting portions of said strap assembly is selectively adjustable by a user.

39. The strap assembly according to claim 37, wherein a portion of said mounting strap is insertable through a portion of said boot-engaging strap member.

40. The strap assembly according to claim 37, wherein said boot-engaging strap member includes a buckle mounted thereto, said buckle configured and arranged to engage said first engaging section of said engagement strap.

41. The strap assembly according to claim 40, wherein said buckle is a ratcheting buckle which matingly engages said first engaging section of said engagement strap for incremental adjustment of the length of said assembly.

42. The strap assembly according to claim 41, wherein said first engaging section of said engagement strap comprises a plurality of serrations and wherein said buckle is adjustably engagable with said plurality of serrations.

43. The strap assembly according to claim 39, wherein said portion of said mounting strap insertable through said portion of said boot-engaging strap member includes an end of said mounting strap, and wherein when said portion of said mounting strap is inserted through said portion of said boot-engaging strap member, said end of said mounting strap is maintained in close proximity to said boot-engaging strap member.

44. The strap assembly according to claim 39, wherein said portion of said mounting strap insertable through said portion of said boot-engaging strap member includes an end of said mounting strap, and wherein when said portion of said mounting strap is inserted through said portion of said boot-engaging strap member, said end of said mounting strap conforms to a contour of said boot-engaging strap member.

45. The strap assembly according to claim 39, wherein said portion of said mounting strap insertable through said portion of said boot-engaging strap member includes an end of said mounting strap, and wherein said strap assembly further comprises means for, when said portion of said mounting strap is inserted through said portion of said boot-engaging strap member, maintaining said end of said mounting strap in close proximity to said boot-engaging strap member.

46. The strap assembly according to claim 39, wherein said portion of said mounting strap insertable through said portion of said boot-engaging strap member includes an end of said mounting strap, and wherein said strap assembly further comprises means for, when said portion of said mounting strap is inserted through said portion of said boot-engaging strap member, conforming said end of said mounting strap to a contour of said boot-engaging strap member.

47. The strap assembly according to claim 39, wherein said portion of said boot-engaging strap member includes an opening, said portion of said mounting strap being insertable through said opening.

48. The strap assembly according to claim 47, wherein said portion of said boot-engaging strap member includes top and bottom walls that define a top and a bottom of said opening.

49. The strap assembly according to claim 48, wherein said portion of said boot-engaging strap member includes sides extending between said top and bottom walls.

50. The strap assembly according to claim 49, wherein said portion of said boot-engaging strap member includes an end extending between said top and bottom walls so that said opening is open only on one end.

51. The strap assembly according to claim 47, wherein said portion of said boot-engaging strap member includes sides.

52. The strap assembly according to claim 47, wherein said opening comprises a slit.

53. A binding for securing a snowboarding boot to a snowboard, the binding comprising:

a binding baseplate securable to the snowboard; and a strap assembly for securing the snowboard boot to said baseplate, said strap assembly comprising:

an engagement strap having a first mounting section mounted to said baseplate and a first engaging section, the first mounting section defining a first mounting portion for said strap assembly;

a boot-engaging strap member having a first section configured and arranged to be releasably connectable to said first engaging section of said engagement strap and a second section, said boot-engaging strap member being configured and arranged to engage the snowboarding boot; and a mounting strap including a second engaging section releasably securable to said second section of said boot-engaging strap member via at least one fastener and a second mounting section mounted to said baseplate, said second mounting section defining a second mounting portion for said strap assembly;

wherein at least one of said boot-engaging strap member and said mounting strap has a plurality of holes, each hole being adapted to receive one of the at least one fastener to releasably secure said second engaging section of said mounting strap and said second section of said boot-engaging strap member; and wherein said boot-engaging strap member and said mounting strap are moveable relative to each other so that a length of said strap assembly between said first and second mounting portions of said strap assembly is selectively adjustable by a user.

54. The binding according to claim 53, wherein said engagement strap is movable relative to said boot-engaging strap member so that the length of said strap assembly between said first and second mounting positions of said strap assembly is selectively adjustable by a user.

55. The binding according to claim 53, wherein a portion of said mounting strap is insertable through a portion of said boot-engaging strap member.

56. The binding according to claim 53, wherein said boot-engaging strap member includes a buckle mounted thereto, said buckle configured and arranged to engage said first engaging section of said engagement strap.

57. The binding according to claim 56, wherein said buckle is a ratcheting buckle which matingly engages said first engaging section of said engagement strap for incremental adjustment of the length of said assembly.

58. The binding according to claim 57, wherein said first engaging section of said engagement strap includes a plurality of serrations and wherein said buckle is adjustably engagable with said plurality of serrations.

59. The binding according to claim 55, wherein said portion of said mounting strap insertable through said portion of said boot-engaging strap member includes an end of said mounting strap, and wherein when said portion of said mounting strap is inserted through said portion of said boot-engaging strap member, said end of said mounting strap is maintained in close proximity to said boot-engaging strap member.

60. The binding according to claim 55, wherein said portion of said mounting strap insertable through said portion of said boot-engaging strap member includes an end of said mounting strap, and wherein when said portion of said mounting strap is inserted through said portion of said boot-engaging strap member, said end of said mounting strap conforms to a contour of said boot-engaging strap member.

61. The binding according to claim 55, wherein said portion of said mounting strap insertable through said portion of said boot-engaging strap member includes an end of said mounting strap, and wherein said strap assembly further comprises means for, when said portion of said mounting strap is inserted through said portion of said boot-engaging strap member, maintaining said end of said mounting strap in close proximity to said boot-engaging strap member.

62. The binding according to claim 55, wherein said portion of said mounting strap insertable through said portion of said boot-engaging strap member includes an end of said mounting strap, and wherein said strap assembly further comprises means for, when said portion of said mounting strap is inserted through said portion of said boot-engaging strap member, conforming said end of said mounting strap to a contour of said boot-engaging strap member.

63. The binding according to claim 55, wherein said portion of said boot-engaging strap member includes an opening, said portion of said mounting strap being insertable through said opening.

64. The binding according to claim 63, wherein said portion of said boot-engaging strap member includes top and bottom walls that define a top and a bottom of said opening.

65. The binding according to claim 64, wherein said portion of said boot-engaging strap member includes sides extending between said top and bottom walls.

66. The binding according to claim 65, wherein said portion of said boot-engaging strap member includes an end extending between said top and bottom walls so that said opening is open only on one end.

67. The binding according to claim 63, wherein said portion of said boot-engaging strap member includes sides.

68. The binding according to claim 63, wherein said opening comprises a slit.

* * * * *